US007257957B2

(12) United States Patent
Lifson et al.

(10) Patent No.: US 7,257,957 B2
(45) Date of Patent: Aug. 21, 2007

(54) UTILIZATION OF BYPASS REFRIGERANT TO PROVIDE REHEAT AND DEHUMIDIFICATION FUNCTION IN REFRIGERANT SYSTEM

(75) Inventors: Alexander Lifson, Manlius, NY (US); Michael F. Taras, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 282 days.

(21) Appl. No.: 10/962,985

(22) Filed: Oct. 12, 2004

(65) Prior Publication Data

US 2006/0075767 A1 Apr. 13, 2006

(51) Int. Cl.
*F25B 41/00* (2006.01)
*F25B 49/00* (2006.01)

(52) U.S. Cl. ..... 62/196.3; 62/186

(58) Field of Classification Search ..... 62/196.1, 62/196.3, 180, 186
See application file for complete search history.

(56) References Cited

U.S. PATENT DOCUMENTS 3,370,437 A * 2/1968 Jacobs ..... 62/160
4,286,435 A * 9/1981 Cann et al. ..... 62/81
4,583,373 A * 4/1986 Shaw ..... 62/196.3
5,642,628 A * 7/1997 Whipple et al. ..... 62/186
6,047,556 A * 4/2000 Lifson ..... 62/196.2

* cited by examiner

*Primary Examiner*—Marc Norman
(74) *Attorney, Agent, or Firm*—Carlson, Gaskey & Olds, PC

(57) ABSTRACT

A refrigerant system is provided with an unloader bypass line to selectively unload the compressor and deliver refrigerant from a partially (or fully) compressed location back to a suction port of the compressor. A section of this unloader bypass line is placed in the path of air having passed over an evaporator and towards an environment to be conditioned. This section of the unloader bypass line would contain refrigerant that is at a higher temperature than the refrigerant, which had been delivered into the evaporator by the main circuit. In this manner, this bypass line section will provide the function of reheating the air above the temperature to which it had been cooled in the evaporator to achieve a desired humidity level. Thus, the reheat function is obtained without requiring a dedicated reheat loop, associated components and additional structure. Also, through the refrigerant temperature reduction, compressor reliability and performance are improved. Furthermore, the flow control device may be of an adjustable type (e.g. modulating or pulsating) to achieve variable sensible heat ratios and to cover a wide range of potential applications. Lastly, the bypass line may have extended heat transfer elements allowing heat transfer enhancement between the air and refrigerant.

17 Claims, 1 Drawing Sheet

UTILIZATION OF BYPASS REFRIGERANT TO PROVIDE REHEAT AND DEHUMIDIFICATION FUNCTION IN REFRIGERANT SYSTEM

BACKGROUND OF THE INVENTION

This application relates to a refrigerant system having a reheat function provided by hot refrigerant in a bypass line.

Refrigerant systems are utilized in applications to change the temperature and humidity or otherwise condition the environment. In a standard refrigerant system, a compressor delivers a compressed refrigerant to a heat exchanger, known as a condenser, which is typically located outside. From the condenser, the refrigerant passes through an expansion device, and then to an indoor heat exchanger, known as an evaporator. At the evaporator, moisture may be removed from the air, and the temperature of air blown over the evaporator coil is lowered. From the evaporator, the refrigerant returns to the compressor. Of course, basic refrigerant cycles are utilized in combination with many configuration variations and optional features. However, the above provides a brief understanding of the fundamental concept.

In some cases, while the system is operating in a cooling mode, the temperature level at which the air is delivered to provide a comfort environment in a conditioned space may need to be higher than the temperature that would provide the ideal humidity level. Generally, the lower the temperature of the evaporator coil is the more moisture can be removed from the air stream. These opposite trends have presented challenges to refrigerant system designers. One way to address such challenges is to utilize various schematics incorporating reheat coils. In many cases, a reheat coil placed in the way of an indoor air stream behind the evaporator is employed for the purpose of reheating the air supplied to the conditioned space after it has been cooled in the evaporator, and where the moisture has been removed from the air as well.

Known reheat systems require additional components such as flow control devices, and are susceptible to refrigerant charge migration problems that may affect system operational characteristics, functionality and reliability over a wide range of environmental and operating conditions. Of course, it is typically beneficial to reduce refrigerant system schematic and control complexity as well as to avoid potential reliability issues.

Also, an unloader or bypass function is often provided in a refrigerant system. In such a function, a portion of the refrigerant is bypassed from an intermediate compression point at the compressor back to the suction line of the compressor. This bypass or unloaded operation is utilized when the system demand for cooling capacity is lower than it might otherwise be. In such a case, by diverting a portion of the refrigerant back to the compressor suction and bypassing other system components, the load on the compressor and other components is reduced. At the same time, the temperature of the combined refrigerant flow (form the bypass and from the evaporator) at the compressor suction is increased, potentially negatively impacting compressor reliability and reducing the mass flow rate the compressor is capable of pumping through.

In some cases, when there is no an intermediate port incorporated in the compressor design, a so-called hot gas bypass is utilized for the unloading function. In such systems, hot discharge refrigerant vapor is diverted back to the compressor suction port (or sometimes to the evaporator inlet), having been passed through an expansion device first to reduce its pressure. As before, the temperature of the combined refrigerant flow at the compressor suction is increased, which may be detrimental for compressor reliability and may negatively impact compressor performance.

SUMMARY OF THE INVENTION

A compressor is provided with a bypass, or an unloader, for selectively bypassing refrigerant at an intermediate or discharge pressure back to a compressor suction port. A flow control selectively bypasses the refrigerant for various known reasons. As an example, should a reduced cooling capacity be necessary, then a portion of the refrigerant is bypassed to reduce the load on the compressor. The amount of the bypassed refrigerant can be controlled if a flow control device on a bypass line has a pulsating or modulating capability.

The refrigerant, fully compressed by the compressor, moves downstream to an outdoor heat exchanger, known as a condenser, an expansion device, and then to an indoor heat exchanger, known as an evaporator. As known, air-moving devices such as fans move air over the condenser, and over the evaporator. The air passing over the evaporator is delivered into an environment to be conditioned. As also known, it is sometimes desirable to remove moisture from the air being delivered to the environment to provide comfort. Typically, dehumidification is achieved by lowering the temperature of the air. In some cases, to remove moisture, it may be necessary to lower the temperature of the air below the level desired by an occupant of the environment. Thus, reheat means are employed that selectively reheat the air to a desired temperature after the appropriate level of humidity has been achieved in the evaporator.

The present invention utilizes the bypass of the compressed refrigerant that is passing from the compressor back to the compressor suction as a source of heat for this reheat function. In this way, a dedicated reheat loop, dedicated components and dedicated flow structure are not necessary. Additionally, potential reliability problems associated with the compressor overheating are avoided and compressor performance is improved.

Furthermore, if the bypass flow control device is equipped with a pulsating or modulating capability, the amount of reheat can be controlled to achieve a desired temperature level.

These and other features of the present invention can be best understood from the following specification and drawings, the following of which is a brief description.

DETAILED DESCRIPTION OF THE PREFERRED EMBODIMENT

Figure 1:
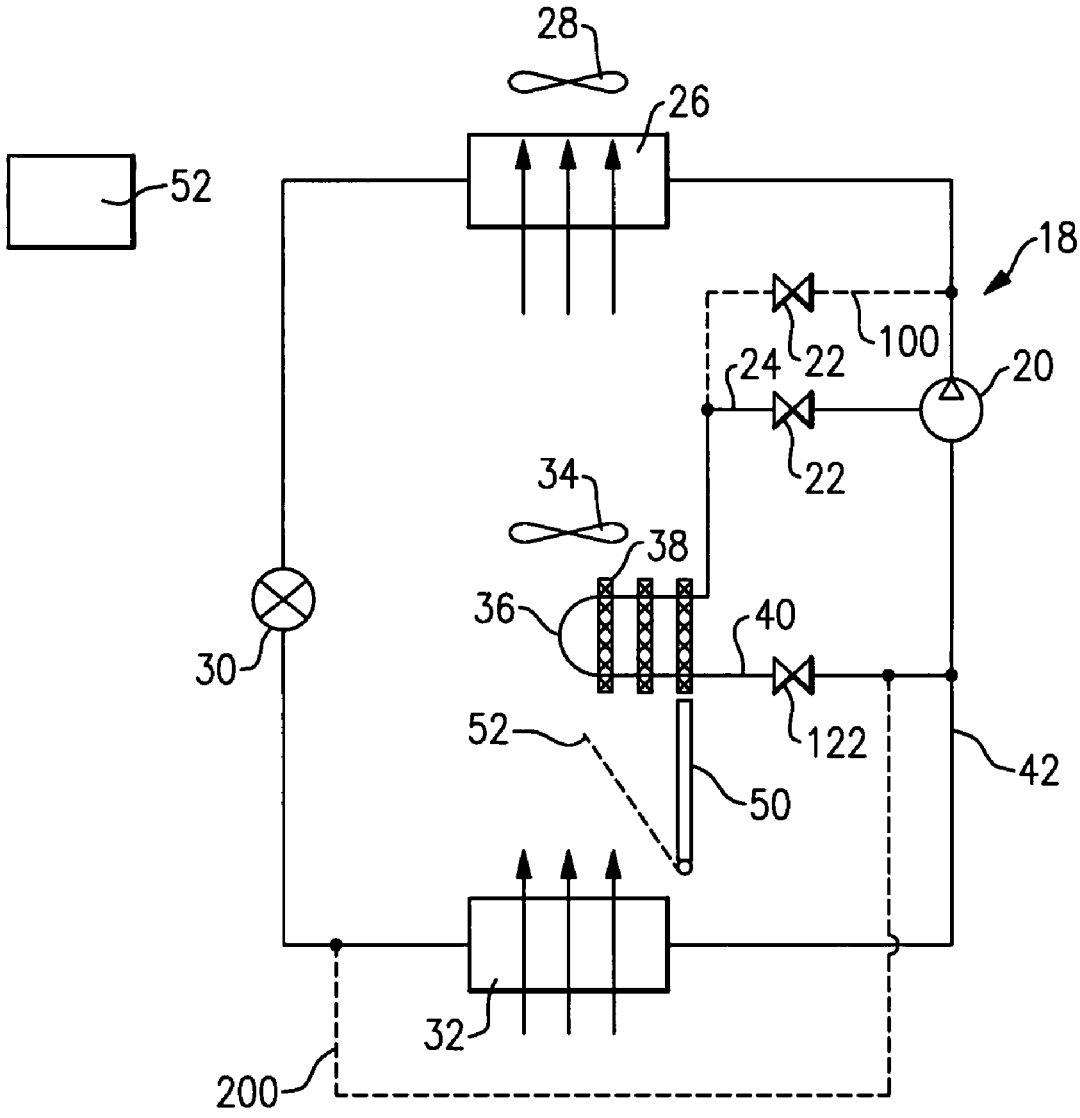
FIG. 1 shows a schematic of the present invention.

A refrigerant cycle 18 includes a compressor 20 having a valve 22 for selectively bypassing a portion of compressed refrigerant into a bypass line 24 and then back to the compressor suction. The main flow of refrigerant that has been compressed by the compressor 20 moves downstream to a condenser 26. An air-moving device 28 moves air over the condenser 26 providing heat transfer interaction (heat rejection) between the refrigerant and air. Downstream of the condenser 26, the refrigerant enters an expansion device 30, and then an evaporator 32. An air-moving device 34 moves air over the evaporator 32 to be cooled and dehumidified, as known. The bypass line 24 has a section 36 placed in the path of this air stream flowing over the evaporator 32. As shown, extended heat transfer structure such as fins 38 may be added to the section 36 to increase its heat transfer capability. As generally known, when a desired dehumidification level is to be achieved, that would result in the air being cooled to a temperature below a comfort level in an environment to be conditioned. When at least a portion of the air passes over the section 36 of the bypass line 24 it is reheated to a desired level. Although the reasons for employing the reheat function are well known to a worker in this art, utilizing a refrigerant bypass line to provide the heat source for the reheat function is novel. Refrigerant returns from the bypass line section 36 through a line 40 to the suction line 42 and then to the compressor 20.

Additionally, the refrigerant enters the compressor at the reduced temperature, improving compressor reliability. The compressor can move an increased refrigerant mass flow rate due to reduced refrigerant temperature at the compressor suction and consequently increased refrigerant density. Thus, the compressor performance is enhanced as well.

Furthermore, in case the bypass flow control device 22 is equipped with the pulsating or modulating function to control the amount of the bypassed refrigerant through the bypass loop including lines 24, 36 and 40, the reheat amount can be controlled as well, offering flexibility of a variable sensible heat ratio (a ratio of the sensible and latent components of the system capacity) to cover a wide range of the external sensible and latent load demands.

It has to be noted that an intermediate compression (bypass) port can be located anywhere within the compression process and specific optimal position of this port is determined by the system and application requirements. In the extreme case, the bypass line can be associated with the discharge port of the compressor and becomes a so-called hot gas bypass, shown in phantom at 100.

Furthermore, as known in the art, and as shown in phantom at 200, the compressor bypass from the intermediate compression chamber or from the discharge port can be diverted to the inlet of the evaporator 32 instead of directly to the compressor suction.

As shown at 122, the valve can alternatively be positioned downstream of the reheat section 36 of the bypass line.

Within the scope of this invention, it is possible to have some diverter 50 for diverting the air around the section 36 of the bypass line should dehumidification not be desired at a point in time when the system is operating at an unloaded (part-load) capacity. That is, it may sometimes not be desirable to have the reheat function operational when it is desirable to have the compressor 20 unloaded. Thus, some diverter, such as shown schematically at 50 may be selectively utilized to divert the air around the section 36 of the bypass line. The detail of the diverter is shown schematically, and a worker of ordinary skill in this art would recognize that many distinct types of diverters or louvers could be utilized. The diverter can be a simple flow valve that when moved to the position shown in phantom at 52, for example, diverts air away from the bypass line section 36.

A control 52 is shown schematically and will operate the various components in the refrigerant cycle 18. A worker of ordinary skill in the art would recognize how to achieve such control given the teachings of this invention.

The system is shown in a very basic schematic. It should be well understood that various additional types of refrigerant cycle options can incorporate this invention. For example, applicant has recently developed systems wherein the reheat function is utilized in heat pumps, with an economizer cycle, for multi-circuit systems, for tandem and variable speed compressors, and various other options. The present invention use of the bypass line to provide the reheat function would have application in any of these, and other schematics.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

a compressor, said compressor being provided with an unloader function to selectively deliver a portion of a refrigerant from said compressor through an unloader bypass line back to the compressor suction port;

a condenser downstream of said compressor and an expansion device downstream of said condenser; and an evaporator downstream of said expansion device, an air-moving device for passing air over said evaporator and into an environment to be conditioned, and said unloader bypass line having at least a section in a path of at least a portion of flow of air passing over said evaporator and driven by said air-moving device.

2. The refrigerant system as set forth in claim 1, wherein said unloader bypass line includes a value that selectively delivers a bypassed portion of refrigerant from said compressor to said compressor suction port, and said section of said unloader bypass line in the path of at least portion of air passing over said evaporator is between said value and said compressor suction port.

3. The refrigerant system as set forth in claim 1, wherein said unloader bypass line includes a valve that selectively delivers a bypassed portion of refrigerant from said compressor to said compressor suction port, and said section of said unloader bypass line in the path of at least portion of air passing over said evaporator is upstream of said valve and said compressor suction port.

4. The refrigerant system as set forth in claim 1, wherein said section of said unloader bypass line is provided with heat transfer enhancement elements.

5. The refrigerant system as set forth in claim 1, wherein a diverter device allows air to be selectively diverted away from said section of said unloader bypass line.

6. The refrigerant system as set forth in claim 5, further comprising a control for selectively operating said diverter when dehumidification of the air being delivered to an environment is not desired.

7. The refrigerant system as set forth in claim 1, wherein said unloader bypass line has a valve that is adjustable.

8. The refrigerant system as set forth in claim 7, wherein said valve is of a modulating type.

9. The refrigerant system as set forth in claim 7, wherein said valve is of a pulsating type.

10. The refrigerant system as set forth in claim 1, wherein said portion of refrigerant is taken from an intermediate pressure port.

11. The refrigerant system as set forth in claim 1, wherein said portion of refrigerant is taken from the discharge port.

12. The refrigerant system as set forth in claim 1, wherein said portion of refrigerant is delivered upstream of said evaporator and then flows to said compressor suction port.

13. The refrigerant system as set forth in claim 1, wherein said evaporator is an indoor heat exchanger.

14. A method of operating a refrigerant system comprising the steps of:

(1) providing a compressor, a condenser, an evaporator, and an air-moving device for passing air over said evaporator, and providing said compressor with an unloader bypass line for selectively delivering a portion of a refrigerant from said compressor back to a compressor suction port; and (2) selectively bypassing refrigerant from said compressor through said unloader bypass line, and said unloader bypass line having a section placed in a path of at least a portion of air being delivered by said air-moving device over said evaporator and into an environment to be conditioned, said section of said unloader bypass line providing a reheat function to selectively raise the temperature of air being delivered into the environment back upwardly from a temperature to which it had been cooled in said evaporator.

15. The method of claim 14, wherein said unloader line is provided with a diverter that selectively diverts air around said section of said unloader bypass line when dehumidification is not desired.

16. The method of claim 14, wherein the bypass is controlled through a valve with at least one of modulation and pulsation control.

17. The method of claim 14, wherein said evaporator is an indoor heat exchanger.

* * * * *